US010011888B2

(12) United States Patent
Tomokiyo et al.

(10) Patent No.: US 10,011,888 B2
(45) Date of Patent: Jul. 3, 2018

(54) COLD-ROLLED STEEL SHEET FOR VITREOUS ENAMELING AND ITS NAMED ENAMELED PRODUCT THEREOF

(71) Applicant: NIPPON STEEL & SUMITOMO METAL CORPORATION, Tokyo (JP)

(72) Inventors: Toshimasa Tomokiyo, Kitakyushu (JP); Shintaro Yamanaka, Kitakyushu (JP); Kengo Takeda, Kimitsu (JP); Satoshi Nishimura, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 321 days.

(21) Appl. No.: 14/916,299

(22) PCT Filed: Sep. 10, 2014

(86) PCT No.: PCT/JP2014/073918
§ 371 (c)(1),
(2) Date: Mar. 3, 2016

(87) PCT Pub. No.: WO2015/037614
PCT Pub. Date: Mar. 19, 2015

(65) Prior Publication Data

US 2016/0201154 A1 Jul. 14, 2016

(30) Foreign Application Priority Data

Sep. 10, 2013 (JP) ..... 2013-187473

(51) Int. Cl.
*C22C 38/02* (2006.01)
*C22C 38/04* (2006.01)
(Continued)

(52) U.S. Cl.
CPC ..... *C21D 9/46* (2013.01); *C21D 8/0236* (2013.01); *C21D 8/0247* (2013.01);
(Continued)

(58) Field of Classification Search
None
See application file for complete search history.

(56) References Cited

U.S. PATENT DOCUMENTS

2010/0040872 A1 2/2010 Murakami et al.
2010/0086431 A1 4/2010 Murakami et al.

FOREIGN PATENT DOCUMENTS

CN 102899565 A 1/2013
JP 61-117246 A 6/1986
(Continued)

OTHER PUBLICATIONS

International Search Report, issued in PCT/JP2014/073918, dated Dec. 16, 2014.
(Continued)

*Primary Examiner* — Deborah Yee
(74) *Attorney, Agent, or Firm* — Birch, Stewart, Kolach & Birch, LLP

(57) ABSTRACT

A cold-rolled steel sheet for vitreous enameling has a predetermined chemical composition, in which a number density of Fe—Mn—Nb-based composite oxides having a diameter of 0.2 μm to 10 μm is $2\times10^2$ particle/mm$^2$ to $1\times10^4$ particle/mm$^2$; a fatigue limit ratio is higher than 0.42 after performing a heat treatment with an applied tensile strain of 10% at a heating temperature of 830° C. for a holding time of 5 minutes; voids are formed between the metallographic structure and the Fe—Mn—Nb-based composite oxides, and an equivalent circle diameter of the voids is 0.1 μm to 0.6 μm; and when each of the voids is approximated as a triangle and a long side of the triangle is set as a base, a value obtained by dividing a length of the base by a height of the triangle is 1.0 to 15.

7 Claims, 2 Drawing Sheets

(51) Int. Cl.

| | |
|---|---|
| ***C22C 38/06*** | (2006.01) |
| ***C22C 38/12*** | (2006.01) |
| ***C22C 38/16*** | (2006.01) |
| ***C21D 9/46*** | (2006.01) |
| ***C22C 38/00*** | (2006.01) |
| ***C22C 38/20*** | (2006.01) |
| ***C22C 38/26*** | (2006.01) |
| ***C22C 38/60*** | (2006.01) |
| ***C21D 8/02*** | (2006.01) |
| ***C21D 9/56*** | (2006.01) |

(52) U.S. Cl.

CPC ..... *C21D 8/0284* (2013.01); *C21D 9/56* (2013.01); *C22C 38/00* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/20* (2013.01); *C22C 38/26* (2013.01); *C22C 38/60* (2013.01); *C21D 2211/004* (2013.01); *C21D 2211/005* (2013.01)

(56) References Cited

FOREIGN PATENT DOCUMENTS

| | | | |
|---|---|---|---|
| JP | 63-3945 | B2 | 1/1988 |
| JP | 3-166336 | A | 7/1991 |
| JP | 6-33187 | A | 2/1994 |
| JP | 7-62211 | A | 3/1995 |
| JP | 9-78190 | A | 3/1997 |
| JP | 11-229087 | A | 8/1999 |
| KR | 10-2005-0068250 | A | 7/2005 |
| KR | 10-2009-0049609 | A | 5/2009 |
| KR | 10-2011-0070408 | A | 6/2011 |
| TW | 200827458 | A | 7/2008 |
| TW | 200829721 | A | 7/2008 |

OTHER PUBLICATIONS

Nagae et al., "Fatigue Properties of High Strength Steel Sheets", Iron and Steel, Year 68 (1982), vol. 9, pp. 1430-1436.

Office Action, issue in TW 103131163, dated Nov. 20, 2015.

Written Opinion of the International Searching Authority, issued in PCT/JP2014/073918 (PCT/ISA/237), dated Dec. 16, 2014.

Notice of Allowance dated Jan. 6, 2017, in Korean Patent Application No. 10-2016-7005745, with English translation.

COLD-ROLLED STEEL SHEET FOR VITREOUS ENAMELING AND ITS NAMED ENAMELED PRODUCT THEREOF

TECHNICAL FIELD OF THE INVENTION

The present invention relates to a high-strength steel sheet for vitreous enameling having excellent workability, enameling characteristics (bubble-black point resistance, adhesion, and fishscale resistance), and fatigue properties, and a method for producing the same. In particular, the present invention relates to a high-strength cold-rolled steel sheet for vitreous enameling having excellent fishscale resistance and fatigue properties after vitreous enameling, and a method for producing the same. In addition, the present invention relates to an enameled product which is obtained using the steel sheet for vitreous enameling.

Priority is claimed on Japanese Patent Application No. 2013-187473, filed on Sep. 10, 2013, the content of which is incorporated herein by reference.

RELATED ART

In the related art, a steel sheet for vitreous enameling is used as an enameled product after being imparted with functions of heat resisting properties, weather resistance, chemical resistance, and water resistance through vitreous enameling in which glass is fused to the steel sheet surface. In addition, by taking advantage of these characteristics, the steel sheet for vitreous enameling is widely used as kitchenware such as pans or sinks or materials such as building materials. Examples of the characteristics required for the steel sheet for vitreous enameling include firing strain resistance, fishscale resistance, adhesion, and bubble-black point resistance. In addition, in the process of producing an enameled product from the steel sheet for vitreous enameling, typically, pressing is performed in order to obtain a desired product shape. To that end, in the steel sheet for vitreous enameling, not only the above-described characteristics but also excellent formability (workability) is required.

In addition, through vitreous enameling, corrosion resistance in a severely corrosive environment containing sulfuric acid or the like is improved. Therefore, recently, the steel sheet for vitreous enameling has been increasingly used in a wide range of fields including the energy fields of power generation facilities and the like (for example, a heat exchanger for a power generator). In these fields, the improvement of reliability against fatigue and the like caused by a long period of use is required. Moreover, in order to reduce the weight of components, high-strengthening of the steel sheet to be used is required.

The high-strengthening of the steel sheet having enameling characteristics is described in, for example, Patent Document 1. In the steel sheet disclosed in Patent Document 1, Ti is added to steel, and TiC is finely precipitated in the steel sheet during enamel firing (firing process in vitreous enameling), thereby realizing high-strengthening. In addition, Patent Document 2 discloses a steel sheet in which not only high-strengthening but also enameling characteristics are simultaneously secured by controlling a ratio between the addition amounts of Ni and P in components of the steel sheet to be within a specific range.

However, in the steel sheet obtained using the technique of Patent Document 1, during vitreous enameling, surface defects such as bubbles or black point flaws are likely to occur. In addition, in a short-term heat treatment during firing, TiC is not likely to be sufficiently produced, and fishscale defects are likely to occur.

In the technique of Patent Document 2, the addition of expensive Ni is essential in order to secure enameling characteristics. Therefore, the characteristics can be secured, but there is a problem from the viewpoint of production cost.

In a steel sheet for a vehicle or the like, in the related art, the improvement of fatigue properties is required, and various studies have been made. However, a technique of improving fatigue properties of the steel sheet for vitreous enameling after vitreous enameling (that is, fatigue properties of an enameled product) has not been reported. For example, Non-Patent Document 1 describes a technique of increasing the P content to improve the fatigue properties of a steel sheet for a vehicle.

However, in the steel sheet for vitreous enameling, unlike the steel sheet for a vehicle, it is necessary that a large amount of precipitates (in particular, oxides), which cause a decrease in fatigue properties, are intentionally dispersed in the metallographic structure in order to secure enameling characteristics, in particular, fishscale resistance. In addition, unlike the steel sheet for a vehicle, in the steel sheet for vitreous enameling, vitreous enameling of performing heating at 800° C. or higher after processing is performed, and thus the metallographic structure is changed by thermal history. Therefore, as shown in FIG. 1, in the steel sheet for vitreous enameling, fatigue properties deteriorate as compared to the steel sheet for a vehicle.

As a result, even when the technique of improving fatigue properties which is performed in the steel sheet for a vehicle is simply applied to the steel sheet for vitreous enameling, the steel sheet for vitreous enameling cannot exhibit sufficient fatigue properties.

As described above, a high-strength steel sheet which sufficiently satisfies important characteristics of the steel sheet for vitreous enameling has not been provided, the characteristics including: fishscale resistance; workability; and fatigue properties of a product which is an index indicating the reliability of the steel sheet.

PRIOR ART DOCUMENT

Patent Document

[Patent Document 1] Japanese Unexamined Patent Application, First Publication No. S61-117246

[Patent Document 2] Japanese Patent No. 1456199

Non-Patent Document

[Non-Patent Document 1] "Fatigue Strength of High-Strength Steel Sheet", Nagae et al., Iron and Steel, Year 68 (1982), Vol. 9, pp. 1430-1436

DISCLOSURE OF THE INVENTION

Problems to be Solved by the Invention

An object of the present invention is to further improve the above-described techniques regarding the steel sheet for vitreous enameling and thus to provide: an inexpensive high-strength steel sheet for vitreous enameling having excellent workability, fishscale resistance, and fatigue properties, in particular, an inexpensive high-strength cold-rolled steel sheet for vitreous enameling having excellent workability, fishscale resistance, and fatigue properties even after vitreous enameling; and a method of producing the same. In addition, another object of the present invention is to provide an enameled product which is obtained using the inexpensive high-strength cold-rolled steel sheet for vitreous enameling having excellent workability, fishscale resistance, and fatigue properties.

Means for Solving the Problem

As a result of various investigations, the present invention has been made in order to solve the problems of the steel sheet for vitreous enameling in the related art. The present inventors have investigated effects of the component composition and production conditions on the fishscale resistance, workability, and fatigue properties of the cold-rolled steel sheet for vitreous enameling, thereby obtaining the following findings (a) to (f).

(a) Fishscale resistance is improved by adjusting the component composition of steel to control precipitates in the steel sheet for entrapping hydrogen in the steel sheet which causes fishscale defects. In particular, when oxides are present in the steel sheet, fishscale resistance is improved.

(b) When the strength of the steel sheet increases, workability deteriorates. However, even when the strength of the steel sheet increases, the deterioration for workability can be reduced by adjusting the diameter and number of precipitates (in the steel sheet for vitreous enameling, in particular, oxides) present in the steel sheet.

(c) In the steel sheet for vitreous enameling, as described above, a large amount of oxides are present in steel. In the steel sheet for vitreous enameling, during processing such as cold rolling or press forming, due to a difference in deformation resistance between the oxides, which are present in the steel sheet, and the steel sheet, voids are formed between the oxides, which are present in steel, and the metallographic structure. Depending on its shape, the voids cause stress concentration due to a notch effect, which may become starting point of fatigue fracture. Therefore, fatigue properties can be improved by appropriately controlling the shape of the voids.

(d) In the steel sheet for vitreous enameling, due to processing, strains are likely to accumulate in the peripheries of the precipitates and the peripheries of the voids. In particular, when bending deformation occurs during press forming, this tendency is remarkable in a surface part (for example, at a distance of less than 20 μm from the surface). Due to the accumulated strains, crystal grains grow during vitreous enameling.

Fatigue properties after vitreous enameling are affected by the grain size of the surface part after vitreous enameling. Therefore, for the improvement of fatigue properties, it is effective to reduce the average grain size. However, even when the average grain size is reduced, crystal grains which are partially coarsened by grain growth become starting point of fatigue fracture. Therefore, fatigue properties decrease. In particular, when grain growth occurs near the voids the grains likely become starting point of fatigue fracture. Such grain growth is not observed in the steel sheet for a vehicle which does not undergo thermal history such as vitreous enameling. Therefore, it is considered that the grain growth is a phenomenon unique to the steel sheet for vitreous enameling.

(e) The grain size of crystal grains can be controlled by appropriately controlling hot rolling, pickling, and cold rolling conditions. In addition, the diameter of oxides can be controlled to be within a preferable range, and the form of precipitates in a final product can be controlled.

Further, during cold rolling, a friction coefficient between a roll and the steel sheet can be controlled to be within an appropriate range through selection of cold rolling oil or the like. As a result, strains accumulating in a surface part can be reduced.

(f) Grain growth during vitreous enameling (enamel firing) can be prevented by controlling the contents of components of the steel sheet, in particular, C, Mn, P, and Nb to be within predetermined ranges. Therefore, by reducing the grain size before processing and adjusting the contents of C, Mn, P, and Nb, the grain size of crystal grains can be reduced after vitreous enameling, and fatigue properties can be improved.

The present invention has been made based on the above findings, and the gist thereof is as follows.

(1) According to an aspect of the present invention, there is provided a cold-rolled steel sheet for vitreous enameling, the steel sheet including, by mass %, C: 0.0005% to 0.0050%, Mn: 0.05% to 1.50%, Si: 0.001% to 0.015%, Al: 0.001% to 0.01%, N: 0.0010% to 0.0045%, O: 0.0150% to 0.0550%, P: 0.04% to 0.10%, S: 0.0050% to 0.050%, Nb: 0.020% to 0.080%, Cu: 0.015% to 0.045%, and a remainder including Fe and impurities, in which when a C content is represented by C (%), a Mn content is represented by Mn (%), a P content is represented by P (%), and a Nb content is represented by Nb (%), the following expression (i) is satisfied; a metallographic structure contains ferrite, and an average grain size of the ferrite at a ¼ thickness position from a surface in a thickness direction is 12.0 μm or less; a number density of Fe—Mn—Nb-based composite oxides containing Fe, Mn, and Nb and having a diameter of 0.2 μm to 10 μm is $2\times10^2$ particle/mm$^2$ to $1\times10^4$ particle/mm$^2$; a fatigue limit ratio, which is a value obtained by dividing a fatigue strength by a tensile strength, is higher than 0.42, the fatigue strength being a stress at $10^7$ cycles after performing a heat treatment with an applied tensile strain of 10% at a heating temperature of 830° C. for a holding time of 5 minutes; voids are formed between the metallographic structure and the Fe—Mn—Nb-based composite oxides, and an equivalent circle diameter of the voids is 0.1 μm to 0.6 μm; and when each of the voids is approximated as a triangle and a long side of the triangle is set as a base, a value obtained by dividing a length of the base by a height of the triangle is 1.0 to 15.

$$2.20 \leq 8\times C\ (\%)+1.3\times Mn\ (\%)+18\times P\ (\%)+5.1\times(Nb\ (\%))^{0.5} \leq 4.00 \quad \text{(i)}$$

(2) According to another aspect of the present invention, there is provided a cold-rolled steel sheet for vitreous enameling, the steel sheet comprising, by mass %, C: 0.0005% to 0.0050%, Mn: 0.05% to 1.50%, Si: 0.001% to 0.015%, Al: 0.001% to 0.01%, N: 0.0010% to 0.0045%, O: 0.0150% to 0.0550%, P: 0.04% to 0.10%, S: 0.0050% to 0.050%, Nb: 0.020% to 0.080%, Cu: 0.015% to 0.045%, B: 0.0005% to 0.0050%, and a remainder including Fe and impurities, in which when a C content is represented by C (%), a Mn content is represented by Mn (%), a P content is represented by P (%), and a Nb content is represented by Nb (%), the following expression (ii) is satisfied; a metallographic structure contains ferrite, and an average grain size of the ferrite at a ¼ thickness position from a surface in a thickness direction is 12.0 μm or less; a number density of Fe—Mn—Nb—B-based composite oxides containing Fe, Mn, Nb, and B and having a diameter of 0.2 μm to 10 μm is $2\times10^2$ particle/mm$^2$ to $1\times10^4$ particle/mm$^2$; a fatigue limit ratio, which is a value obtained by dividing a fatigue strength by a tensile strength, is higher than 0.42, the fatigue strength being a stress at $10^7$ cycles after performing a heat treatment with an applied tensile strain of 10% at a heating temperature of 830° C. for a holding time of 5 minutes; voids are formed between the metallographic structure and the Fe—Mn—Nb—B-based composite oxides, and an equivalent circle diameter of the voids is 0.1 μm to 0.6 μm; and when each of the voids is approximated as a triangle and a long side of the triangle is set as a base, a value obtained by dividing a length of the base by a height of the triangle is 1.0 to 15.

$$2.50 \leq 8\times C\ (\%)+1.3\times Mn\ (\%)+18\times P\ (\%)+5.1\times(Nb\ (\%))^{0.5} \leq 4.00 \quad \text{(ii)}$$

(3) The cold-rolled steel sheet for vitreous enameling according to (1) or (2) may further contain, by mass %, one or more elements selected from the group consisting of Cr, V, Zr, Ni, As, Ti, Se, Ta, W, Mo, Sn, Sb, La, Ce, Ca, and Mg, in which a total amount of the elements may be 0.1% or lower.

(4) According to still another aspect of the present invention, there is provided an enameled product which is produced using the cold-rolled steel sheet for vitreous enameling according to (1) to (2).

(5) According to still another aspect of the present invention, there is provided an enameled product which is produced using the cold-rolled steel sheet for vitreous enameling according to (3).

Effects of the Invention

According to the present invention, it is possible to provide: a high-strength steel sheet for vitreous enameling having excellent workability, fishscale resistance, and fatigue properties after vitreous enameling; and an enameled product which is produced using the cold-rolled steel sheet. When the high-strength cold-rolled steel sheet for vitreous enameling according to the present invention is applied to the energy fields in addition to kitchenware and building materials, the reliability against fatigue and the like caused by a long period of use can be improved, and the weight of a product can be reduced.

EMBODIMENTS OF THE INVENTION

Figure 1:
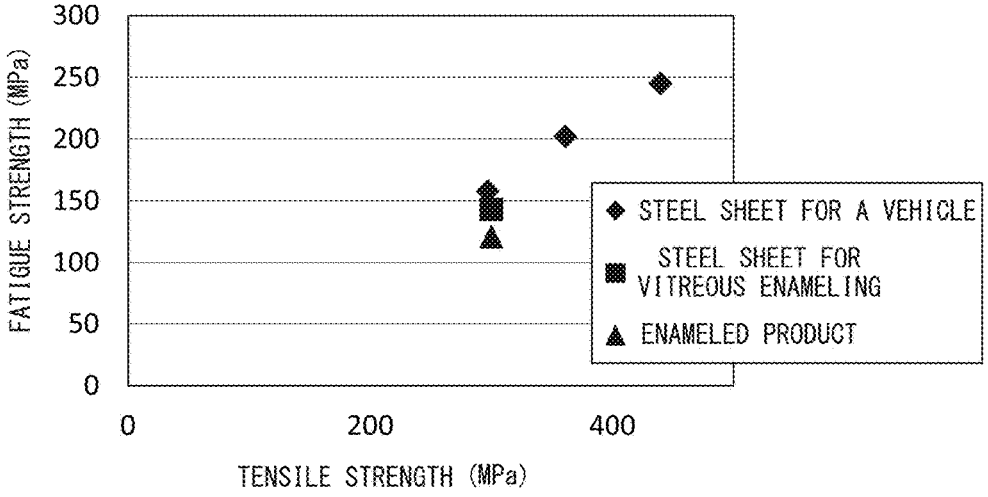
FIG. 1 is a diagram showing a relationship between tensile strengths and fatigue strengths of various steel sheets.

Hereinafter, a high-strength cold-rolled steel sheet for vitreous enameling according to an embodiment of the present invention (hereinafter, also referred to as "steel sheet for vitreous enameling according to the embodiment") having excellent workability, fishscale resistance, and fatigue properties after vitreous enameling; a method for producing the same (hereinafter, also referred to as "method for producing a steel sheet for vitreous enameling according to the embodiment); and an enameled product which is produced using the high-strength cold-rolled steel sheet for vitreous enameling according to the embodiment (hereinafter, also referred to as "enameled product according to the embodiment") having excellent workability and fishscale resistance will be described.

First, the reason for limiting the component composition (chemical composition) of a steel sheet for vitreous enameling according to the embodiment will be described. Here, "%" regarding the component composition represents "mass %".

The enameled product according to the embodiment is produced using the steel sheet for vitreous enameling according to the embodiment. Therefore, the component composition of the enameled product according to the embodiment is the same as that of the steel sheet for vitreous enameling according to the embodiment.

C: 0.0005% to 0.0050%

C exhibits higher workability as the content thereof becomes lower. Therefore, the upper limit of the C content is set as 0.0050%. In order to improve elongation and r value which are indices indicating workability, it is preferable that the upper limit of the C content is set as 0.0025%. It is more preferable that the upper limit of the C content is set as 0.0015%. From the viewpoint of securing characteristics of the steel sheet, the lower limit of the C content is not particularly limited. However, when the C content is reduced more than necessary, the steelmaking cost increases. In addition, in order to secure the strength as a product, it is necessary to increase the contents of other alloy elements, which increases the production cost. Therefore, it is preferable that the lower limit of the C content is set as 0.0005%. It is more preferable that the lower limit of the C content is set as 0.0010%.

Mn: 0.05% to 1.50%

Mn relates to the O content, the Nb content, and the B content and affects the composition of oxides which contribute to the improvement of fishscale resistance of the steel sheet for vitreous enameling. In addition, Mn also affects the high-strengthening of the steel sheet. Therefore, Mn is an important element in the steel sheet for vitreous enameling. In addition, Mn is an element which prevents hot brittleness caused by the presence of S during hot rolling. In order to obtain the effects, in the steel sheet for vitreous enameling according to the embodiment containing O, the lower limit of the Mn content is set as 0.05%.

Typically, as the Mn content increases, enamel adhesion deteriorates, and bubbles and black points are likely to occur. When Mn is present in steel as an oxide, deterioration in enamel adhesion and bubble-black point resistance is small. Accordingly, in the steel sheet for vitreous enameling according to the embodiment, Mn is actively used to control oxides and to secure the strength of the steel sheet. However, when the Mn content exceeds 1.50%, solidifying segregation is likely to occur, which may impair toughness and mechanical properties. Therefore, the upper limit of the Mn content is set as 1.50%. It is preferable that the upper limit of the Mn content is 1.20%.

Si: 0.001% to 0.015%

Si is an element having an effect of controlling the composition of oxides. In order to obtain this effect, it is necessary that the lower limit of the Si content is set as 0.001%. It is preferable that the lower limit of the Si content is set as 0.005%. On the other hand, when the Si content is excessively high, enameling characteristics deteriorate. In particular, during hot rolling, a large amount of Si oxides are formed, and fishscale resistance may deteriorate. Therefore, the upper limit of the Si content is set as 0.015%. In order to improve bubble-black point resistance and to obtain excellent surface properties, it is preferable that the upper limit of the Si content is set as 0.008%.

Al: 0.001% to 0.010%

Al is an element which is effective for deoxidation of steel. However, since Al is a strong deoxidizing element, it is necessary to carefully control the Al content. When the Al content exceeds 0.010%, it is difficult to maintain the O content in steel to be within a range which is required for the steel sheet for vitreous enameling according to the embodiment. In this case, it is difficult to form desired composite oxides, and the number density of composite oxides which are effective for fishscale resistance decreases. In addition, an Al oxide having poor ductility during hot rolling is formed, which causes deterioration in fishscale resistance. In this case, it is difficult to control oxides which are effective for the improvement of fishscale resistance. Therefore, the upper limit of the Al content is set as 0.010%. On the other hand, when the Al content is lower than 0.001%, a high load is applied during the steelmaking process. Therefore, the lower limit of the Al content is set as 0.001%. It is preferable that the lower limit of the Al content is set as 0.003%.

N: 0.0010% to 0.0045%

N is an interstitial solid solution element. In a case where a large amount of N is contained, even when a nitride-forming element such as Nb or B is added, workability tends to decrease, and it is difficult to produce a non-aging steel sheet. Therefore, the upper limit of the N content is set as 0.0045%. The lower limit of the N content is not particularly limited. However, in the existing techniques, a significantly high cost is required to reduce the N content to be 0.0010% or lower. Therefore, the lower limit of the N content may be set as 0.0010%. It is more preferable that the lower limit of the N content is set as 0.0020%.

O: 0.0150% to 0.0550%

O is an element which is required to form composite oxides and directly affects fishscale resistance and workability. In addition, the O content relates to the Mn content, the Nb content, and the B content and affects fishscale resistance, that is, the number density of composite oxides and the size of voids present in steel. Therefore, O is an essential element for the steel sheet for vitreous enameling according to the embodiment. In order to obtain the effects, the lower limit of the O content is set as 0.0150%. It is preferable that the lower limit of the O content is set as 0.0200%. When the O content is excessively reduced, the number density of composite oxides present in the steel sheet is reduced, and concurrently, the size of voids formed during the production process is also reduced. Therefore, fishscale resistance deteriorates. On the other hand, when the O content is excessively high, the number density of composite oxides formed and the size thereof increase. In this case, the size of voids formed during a rolling process increases, which causes deterioration in workability. Therefore, the upper limit of the O content is set as 0.0550%. It is preferable that the upper limit of the O content is set as 0.0450%.

P: 0.040% to 0.100%

P is an element which is effective to refine the grain size of the steel sheet and to strengthen the steel sheet. In order to obtain the effect, the lower limit of the P content is set as 0.040%. It is preferable that the lower limit of the P content is set as 0.050%. On the other hand, when the P content is excessively high, during enamel firing, a high concentration of P segregates in grain boundaries of the steel sheet, which may cause bubbles, black points, and the like. Therefore, the upper limit of the P content is 0.100%. It is preferable that the upper limit of the P content is set as 0.075%.

S: 0.0050% to 0.0500%,

S is an element which forms a Mn sulfide with Mn. By precipitating the Mn sulfide and oxides as complex precipitates, fishscale resistance can be significantly improved. In order to obtain the effect, the lower limit of the S content is set as 0.0050%. The lower limit of the S content is preferably 0.0100% and more preferably 0.0150%. However, when the S content is excessively high, the effect of Mn which is required to control oxides may deteriorate. Therefore, the upper limit of the S content is set as 0.0500%. It is preferable that the upper limit of the S content is set as 0.0300%.

Nb: 0.020% to 0.080%

Nb is an essential element for the steel sheet for vitreous enameling according to the embodiment. Nb relates to the O content, the Mn content, and the B content and affects the composition of oxides which contribute to the improvement of fishscale resistance of the steel sheet for vitreous enameling. In addition, Nb is an element which also contributes to high-strengthening of the steel sheet through the refinement of crystal grains. In order to obtain the effects, the lower limit of the Nb content is set as 0.020%. It is preferable that the lower limit of the Nb content is set as 0.040%. On the other hand, when the Nb content is excessively high, deoxidation occurs during the addition of Nb, and it is difficult to form oxides in steel. Therefore, the upper limit of the Nb content is set as 0.080%. The upper limit of the Nb content is preferably 0.060% and more preferably 0.055%.

Cu: 0.015% to 0.045%

Cu is an element having an effect of controlling a reaction between glass and the steel sheet during enamel firing. In order to obtain the effect, the lower limit of the Cu content is set as 0.015%. It is preferable that the lower limit of the Cu content is set as 0.020%. On the other hand, when the Cu content is excessively high, a reaction between glass and the steel sheet is inhibited, and the workability of the steel sheet may deteriorate. Therefore, the upper limit of the Cu content is set as 0.045%. The upper limit of the Cu content is preferably 0.040% and more preferably 0.030%.

B: 0.0005% to 0.0050%

When the steel sheet for vitreous enameling according to the embodiment containing Mn, Nb, and O as essential elements contains B, the control range of oxides increases, which is effective for the improvement of fishscale resistance. Even when the steel sheet does not contain B, the steel sheet for vitreous enameling having excellent fishscale resistance can be obtained. However, by the steel sheet containing B, fishscale resistance can be easily improved. In order to obtain the effect, it is necessary that the B content is set as 0.0005% or higher. In addition, B is an element having an effect of improving enamel adhesion. From the viewpoint of adhesion, the lower limit of the B content is preferably 0.0010% and more preferably 0.0015%.

On the other hand, when the B content is excessively high, castability in the steelmaking process deteriorates. Therefore, the upper limit of the B content is set as 0.0050%. In addition, when the Nb content is relatively high, when the B content is excessively high, the recrystallization temperature significantly increases, and workability after cold rolling and annealing deteriorates. In addition, when the B content is excessively high, in order to obtain sufficient workability, it is necessary that annealing is performed at a significantly high temperature, which causes deterioration in the productivity of annealing. Therefore, from this point of view, the upper limit of the B content is set as 0.0050%. It is preferable that the upper limit of the B content is set as 0.0035%.

Fundamentally, the steel sheet for vitreous enameling according to the embodiment contains the above-described elements and a remainder including Fe and impurities. However, optionally, the steel sheet further contains one or more elements selected from the group consisting of Cr, V, Zr, Ni, As, Ti, Se, Ta, W, Mo, Sn, Sb, La, Ce, Ca, and Mg, in which the total amount of the elements is 1.0% or lower.

One or more elements selected from the group consisting of Cr, V, Zr Ni, As, Ti, Se, Ta, W, Mo, Sn, Sb, La, Ce, Ca, and Mg: 1.0% or Lower in Total Cr, V, Zr, Ni, As, Ti, Se, Ta, W, Mo, Sn, Sb, La, Ce, Ca, and Mg are unavoidably incorporated from steel raw materials such as ores or scrap. Therefore, it is not necessary that the elements are actively added. However, as in the case of Nb, the elements form oxides to exhibit an effect of preventing fishscale defects. Therefore, the total amount of one or two or more of the elements may be 1.0% or lower. The total amount of the elements is preferably 0.5% or lower and more preferably 0.1% or lower. When the total amount of the elements is excessively high, a reaction with an oxide-forming element is intolerable, and it is difficult to control the formation of desired oxides. As a result, fishscale resistance deteriorates. In addition, when the total amount of the elements is excessively high, undesired oxides are formed in the steel sheet, and workability deteriorates.

Further, when the steel sheet for vitreous enameling according to the embodiment does not contain B, it is necessary that the contents of C, Mn, P and Nb, among the elements, which affect workability, fishscale resistance, and fatigue properties and enamel adhesion after vitreous enameling satisfy the following expression (1).

$$2.20 \leq 8\times C\ (\%)+1.3\times Mn\ (\%)+18\times P\ (\%)+5.1\times(Nb\ (\%))^{0.5} \leq 4.00 \quad (1)$$

In the expression (1), C (%), Mn (%), P (%), and Nb (%) represent the contents of C, Mn, P, and Nb, respectively.

In addition, when the steel sheet for vitreous enameling according to the embodiment contains B, it is necessary that the contents of C, Mn, P, and Nb satisfy the following expression (2).

$$2.50 \leq 8\times C\ (\%)+1.3\times Mn\ (\%)+18\times P\ (\%)+5.1\times(Nb\ (\%))^{0.5} \leq 4.00 \quad (2)$$

Typically, as the tensile strength of the steel sheet increases, the fatigue properties of the steel sheet increase. However, in order for the steel sheet for vitreous enameling to be used as an enameled product, it is necessary that the steel sheet undergoes a thermal history of performing heating (firing) for vitreous enameling at a temperature of higher than 800° C. after being processed into a desired shape. Due to processing and vitreous enameling, the metallographic structure of the steel sheet is changed. Therefore, the tensile strength of the steel sheet after vitreous enameling is different from that before vitreous enameling.

Focusing on the change of the metallographic structure before and after vitreous enameling, the present inventors found that C, Mn, P, and Nb contained in the steel sheet largely affected the change of the metallographic structure before and after vitreous enameling. In addition, it was found that, when the contents of C, Mn, P, and Nb in the steel sheet satisfy a predetermined relational expression, the change of the metallographic structure is suppressed, and the effects of the elements are added, respectively.

The present inventors prepared steel sheets having various component compositions which contain Mn, Si, Al, N, O, P, S, Nb, and Cu and optionally further contain one element or two or more elements selected from the group consisting of Cr, V, Zr, Ni, As, Ti, Se, Ta, W, Mo, Sn, Sb, La, Ce, Ca, and Mg while changing the contents of C, Mn, P, and Nb. After applying a tensile strain of 10% to the steel sheets, a heat treatment of 830° C.×5 min corresponding to vitreous enameling was performed. Next, a fatigue test was performed using the steel sheets to investigate a relationship between the fatigue limit ratio and the expression (1) of "$8\times C\ (\%)+1.3\times Mn\ (\%)+18\times P\ (\%)+5.1\times(Nb\ (\%))^{0.5}$" (hereinafter, referred to as "expression (1x)").

As a result, the following was found: when the value of the expression (1x) is 2.20 or higher, the fatigue strength corresponding to the tensile strength of the steel sheet which undergoes processing and vitreous enameling is exhibited (that is, a sufficient fatigue limit ratio is exhibited); and when the value of the expression (1x) is lower than 2.20, the fatigue strength relative to the tensile strength of the steel sheet is reduced (that is, a fatigue limit ratio is reduced). It is preferable that the value of the expression (1x) is 2.40 or higher.

In addition, the present inventors prepared steel sheets having various component compositions which contain Mn, Si, Al, N, O, P, S, Nb, Cu, and B and optionally further contain one element or two or more elements selected from the group consisting of Cr, V, Zr, Ni, As, Ti, Se, Ta, W, Mo, Sn, Sb, La, Ce, Ca, and Mg while changing the contents of C, Mn, P, and Nb. After applying a tensile strain of 10% to the steel sheets, a heat treatment of 830° C.×5 min corresponding to vitreous enameling was performed. Next, a fatigue test was performed using the steel sheets to investigate a relationship between the fatigue limit ratio and the expression (2) of "$8\times C\ (\%)+1.3\times Mn\ (\%)+18\times P\ (\%)+5.1\times(Nb\ (\%))^{0.5}$" (hereinafter, referred to as "expression (2x)").

As a result, the following was found: when the value of the expression (2x) is 2.50 or higher, a fatigue strength corresponding to the tensile strength of the steel sheet which undergoes processing and vitreous enameling is exhibited; and when the value of the expression (2x) is lower than 2.50, a fatigue strength relative to the tensile strength of the steel sheet is reduced. It is preferable that the value of the expression (2x) is 2.70 or higher.

When the structures of the steel sheets after the fatigue test were observed, it was found that the grain size of all the steel sheets increased. However, in the steel sheets containing no B in which the value of the expression (1x) was 2.20 or higher and in the steel sheets containing 13 in which the value of the expression (2x) was 2.50 or higher, it was found that crystal grains were coarsened, but the coarsening degree thereof was small.

The reason why fatigue properties after vitreous enameling are changed depending on the component composition of the steel sheet is not necessarily clear. However, it is presumed that, by adding predetermined amounts of C, Mn, P, and Nb within ranges which satisfy the expression (1) or (2), grain growth during vitreous enameling is suppressed and a decrease in fatigue strength (fatigue limit ratio) relative to the tensile strength of the steel sheet can be prevented.

On the other hand, when the values of the expressions (1x) and (2x) exceed 4.00, adhesion between the steel sheet and glass during vitreous enameling deteriorates. Therefore, the upper limits of the expressions (1x) and (2x) are set as 4.00. The preferable upper limits are 3.50.

Next, composite oxides containing Fe, Mn, and Nb and composite oxides containing Fe, Mn, Nb, and B will be described.

In the steel sheet for vitreous enameling according to the embodiment, when the steel sheet does not contain B, composite oxides containing Fe, Mn, and Nb, in particular, Fe—Mn—Nb-based composite oxides in which oxides formed of Fe, Mn, and Nb are combined are present. In addition, when the steel sheet contains B, composite oxides containing Fe, Mn, Nb, and B, in particular, Fe—Mn—Nb—B-based composite oxides in which oxides formed of Fe, Mn, Nb, and B are combined are present. Among the composite oxides, the number density of composite oxides having a diameter of 0.2 μm to 10 μm in the steel sheet is preferably $2\times10^2$ particle/mm$^2$ to $1\times10^4$ particle/mm$^2$. The Fe—Mn—Nb-based composite oxides and the Fe—Mn—Nb—B-based composite oxides have the same effect and thus will also be referred to as "composite oxides according to the embodiment".

The degree to which composite oxides having a diameter of lower than 0.2 μm contribute to the improvement of fishscale resistance is small. Therefore, the diameter of the composite oxides according to the embodiment is set to be 0.2 μm or more. The diameter of the composite oxides according to the embodiment is preferably 0.5 μm or more and more preferably 1.0 μm or more. The definition of the diameter of the composite oxides according to the embodiment and the method of measuring the diameter will be described below.

The upper limit of the diameter of the composite oxides according to the embodiment is not particularly limited from the viewpoint of improving fishscale resistance. However, when the amount of coarse composite oxides increases, the number density of composite oxides decreases, and the effect of inhibiting hydrogen permeation is reduced. Therefore, the effect of improving fishscale resistance is not obtained. In addition, coarse composite oxides are likely to cause cracking during processing. Therefore, when the amount of coarse composite oxides increases, workability decreases. Even if cracking does not occur, due to a difference between the workability of the composite oxides and the workability of the metallographic structure during processing, coarse voids are formed near boundaries between the composite oxides and the metallographic structure. As a result, the fatigue properties of an enameled product decrease, and the reliability deteriorates.

Therefore, the diameter of the composite oxides according to the embodiment is set to be 10 μm or less. The diameter of the composite oxides according to the embodiment is preferably 5 μm or less.

When the number density of the composite oxides according to the embodiment in the steel sheet is less than $2\times10^2$ particle/mm$^2$, excellent fishscale resistance cannot be secured. Therefore, the number density of the composite oxides according to the embodiment is necessarily $2\times10^2$ particle/mm$^2$ or more. The number density of the composite oxides according to the embodiment is preferably $5\times10^2$ particle/mm$^2$ or more.

On the other hand, when the number density of the composite oxides according to the embodiment in the steel sheet is more than $1\times10^4$ particle/mm$^2$, an excess amount of voids are formed in the boundaries between the composite oxides and the metallographic structure during processing, and the fatigue properties of an enameled product decrease. Therefore, the number density of the composite oxides according to the embodiment in the steel sheet is set to be $1\times10^4$ particle/mm$^2$ or less. The number density of the composite oxides according to the embodiment is preferably $5\times10^3$ particle/mm$^2$ or less.

A method of identifying the composite oxides according to the embodiment is not particularly limited. For example, (a) oxides from which Fe, Mn, Nb, and O are simultaneously detected or (b) oxides from which Fe, Mn, Nb, 0, and 13 are simultaneously detected may be identified as the composite oxides according to the embodiment. In order to identify the oxides, for example, a field emission scanning electron microscope (FE-SEM) or an energy dispersive X-ray analyzer (EDAX) may be used.

In order to identify the composite oxides, a typical measurement method may be used. However, since it is necessary that the concentration of a micro region is determined, it should be noted that the beam diameter of electron beams is sufficiently reduced.

The diameter and density of the composite oxides were defined using the following method. That is, using a SEM, at an arbitrary position of the steel sheet, the dimension and number of the composite oxides were measured in 10 or more view fields at a magnification of 5000-fold, and the long diameter of the composite oxides was measured as the diameter of the oxides. Among the oxides in the view fields, the number of composite oxides having a long diameter of 0.2 μm or more was calculated, and the density (number density) per unit area (mm$^2$) was calculated based on the number of composite oxides.

Next, the structure (metallographic structure) of the steel sheet for vitreous enameling according to the embodiment will be described.

The structure of the steel sheet for vitreous enameling according to the embodiment mainly including ferrite as a major component. Therefore, in order to improve fatigue properties in addition to high-strengthening, it is effective to reduce the grain size of crystal grains. In order to be used as an enameled product, as described below, the steel sheet for vitreous enameling is processed into a desired product shape by pressing or the like, is coated with an enamel, and then is heated to a temperature of higher than about 800° C. Due to this heating, the adhesion between glass of the enamel and the steel sheet is realized. Due to this heat treatment (vitreous enameling), the grain size is changed by grain growth, and thus fatigue strength is also changed. For the improvement of the fatigue strength of the steel sheet after vitreous enameling, it is effective to reduce the grain size after vitreous enameling. In order to reduce the grain size after vitreous enameling, it is important to reduce the grain size before the heat treatment and to suppress the grain growth caused by vitreous enameling.

It is necessary that the average grain size of ferrite in the metallographic structure before the heat treatment (vitreous enameling) is 12.0 μm or less at a ¼ thickness (¼t) position from the surface in the thickness direction. When the average grain size exceeds 12.0 μm, it is difficult to realize the high-strengthening of the steel sheet. In order to realize high-strengthening, the less the average grain size, the better. However, as the average grain size decreases, workability deteriorates. Therefore, it is necessary to determine the optimum grain size for the desired product shape.

Further, typically, fatigue fracture leads to breaking due to the initiation and propagation of cracking. Cracking is likely to be initiated from the surface of the steel sheet. Therefore, for the improvement of fatigue properties, it is preferable to reduce the grain size of the surface of the steel sheet. The grain size of the steel sheet for vitreous enameling is affected by the concentrations of elements, in particular, P in steel. As the P concentration increases, the grain size tends to decrease. The P concentration distribution in the steel sheet is changed in the hot rolling and pickling processes.

In the steel sheet for vitreous enameling according to the embodiment, the P concentration at a position (surface part) at a distance of 20 μm from the surface in the thickness direction is higher than that at the ¼t position where the average grain size is measured. As a result, the grain size of the surface part is less than that of the ¼t portion. In the steel sheet for vitreous enameling according to the embodiment, when the P content (average concentration) in steel is about 0.04% or higher, the grain size of the surface of the steel sheet is further reduced, which contributes to the improvement of fatigue properties. The concentration distribution of the elements can be measured by, glow discharge optical emission spectrometry and the like. The average grain size of ferrite may be measured according to, an intercept method defined in JIS G 0552 and the like.

Further, in order to suppress the grain growth caused by vitreous enameling, it is important for the contents of C, Mn, P, and Nb among the components to satisfy the following expression (1) when the steel sheet does not contain B and to satisfy the following expression (2) when the steel sheet contains B.

$$2.20 \leq 8\times C\ (\%)+1.3\times Mn\ (\%)+18\times P\ (\%)+5.1\times(Nb\ (\%))^{0.5} \leq 4.00 \quad (1)$$

$$2.50 \leq 8\times C\ (\%)+1.3\times Mn\ (\%)+18\times P\ (\%)+5.1\times(Nb\ (\%))^{0.5} \leq 4.00 \quad (2)$$

When the value of the expression (1) is less than 2.20 or when the value of the expression (2) is less than 2.50, fatigue properties of an enameled product which is obtained after the steel sheet for vitreous enameling undergoes processing and vitreous enameling decrease.

In a laboratory, the present inventors prepared: steel sheets containing, as components, C, Mn, Si, Al, N, O, P, S, Nb, and Cu and optionally further containing some of Cr, V, Zr, Ni, As, Ti, Se, Ta, W, Mo, Sn, Sb, La, Ce, Ca, and Mg; and steel sheets containing C, Mn, Si, Al, N, O, P, S, Nb, Cu, and B and optionally further containing some of Cr, V, Zr, Ni, As, Ti, Se, Ta, W, Mo, Sn, Sb, La, Ce, Ca, and Mg. By changing the contents of C, Mn, P, and Nb, steel sheets having various component compositions were prepared. In addition, using these steel sheets, a fatigue test was performed after a heat treatment of 830° C.×5 min was performed with an applied tensile strain of 10% to investigate a relationship between the fatigue limit ratio and "$8\times C\ (\%)+1.3\times Mn\ (\%)+18\times P\ (\%)+5.1\times(Nb\ (\%))^{0.5}$" of the expressions (1) and (2).

Figure 2:
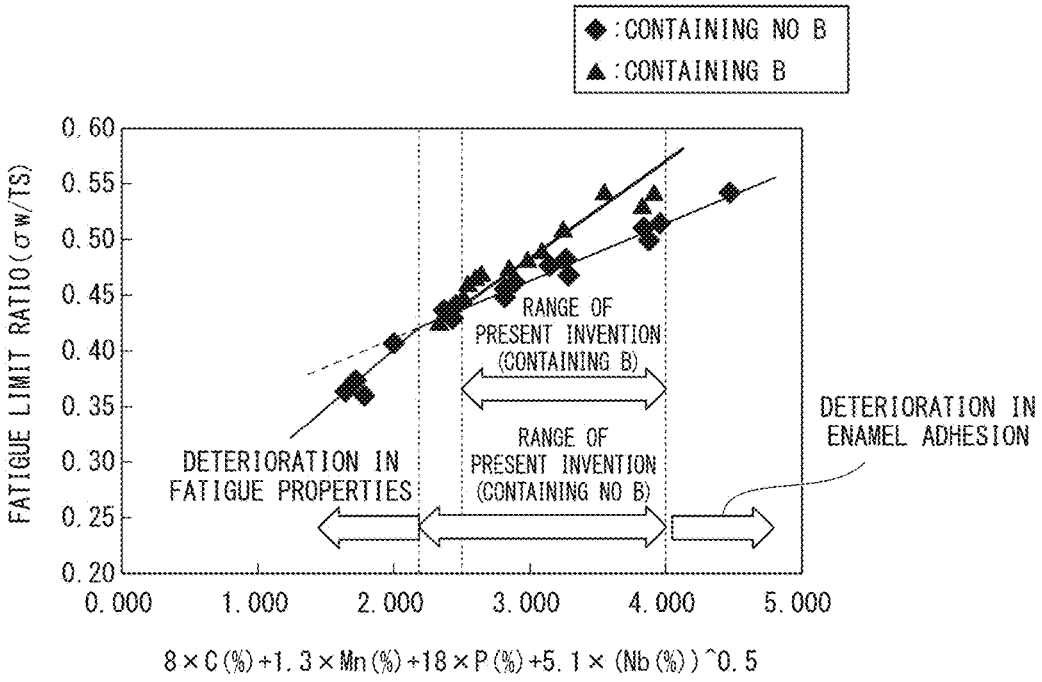
FIG. 2 is a diagram showing a relationship between a value of $8\times C\ (\%)+1.3\times Mn\ (\%)+18\times P\ (\%)+5.1\times(Nb\ (\%))^{0.5}$ and a fatigue limit ratio.

The results are illustrated in FIG. 2. In the drawing, the horizontal axis represents the value of "$8\times C\ (\%)+1.3\times Mn\ (\%)+18\times P\ (\%)+5.1\times(Nb\ (\%))^{0.5}$" of the expressions (1) and (2), and the vertical axis represents the fatigue limit ratio, that is, a value (σw/TS) which is obtained by dividing a fatigue strength (σw) by a tensile strength (TS) measured in a tension test, the fatigue strength being a stress at $10^7$ cycles.

The following results were found. When the value of "$8\times C\ (\%)+1.3\times Mn\ (\%)+18\times P\ (\%)+5.1\times(Nb\ (\%))^{0.5}$" of the expression (1) was 2.20 or higher, a predetermined relationship was established between the fatigue limit ratio and the value of "$8\times C\ (\%)+1.3\times Mn\ (\%)+18\times P\ (\%)+5.1\times(Nb\ (\%))^{0.5}$" of the expression (1). As the value of "$8\times C\ (\%)+1.3\times Mn\ (\%)+18\times P\ (\%)+5.1\times(Nb\ (\%))^{0.5}$" of the expression (1) increased, the fatigue limit ratio was improved. On the other hand, when the value of "$8\times C\ (\%)+1.3\times Mn\ (\%)+18\times P\ (\%)+5.1\times(Nb\ (\%))^{0.5}$" of the expression (1) was lower than 2.20, the above-described relationship was not satisfied, and a decrease in fatigue limit ratio increased. When the metallographic structure was observed after the fatigue test, the following results were found. In the steel sheets in which the value of "$8\times C\ (\%)+1.3\times Mn\ (\%)+18\times P\ (\%)+5.1\times(Nb\ (\%))^{0.5}$" was less than 2.20, the grain size increased. In the steel sheets in which the value of "$8\times C\ (\%)+1.3\times Mn\ (\%)+18\times P\ (\%)+5.1\times(Nb\ (\%))^{0.5}$" was 2.20 or higher, crystal grains of the steel sheet were coarsened, but the coarsening degree thereof was small.

The following results were found. When the value of "$8\times C\ (\%)+1.3\times Mn\ (\%)+18\times P\ (\%)+5.1\times(Nb\ (\%))^{0.5}$" of the expression (2) was 2.20 or higher, a predetermined relationship was established between the fatigue limit ratio and the value of "$8\times C\ (\%)+1.3\times Mn\ (\%)+18\times P\ (\%)+5.1\times(Nb\ (\%))^{0.5}$" of the expression (1). As the value of "$8\times C\ (\%)+1.3\times Mn\ (\%)+18\times P\ (\%)+5.1\times(Nb\ (\%))^{0.5}$" of the expression (1) increased, the fatigue limit ratio was improved. When the metallographic structure was observed after the fatigue test, the following results were found. In the steel sheets in which the value of "$8\times C\ (\%)+1.3\times Mn\ (\%)+18\times P\ (\%)+5.1\times(Nb\ (\%))^{0.5}$" was less than 2.50, the grain size increased. In the steel sheets in which the value of "$8\times C\ (\%)+1.3\times Mn\ (\%)+18\times P\ (\%)+5.1\times(Nb\ (\%))^{0.5}$" was 2.50 or higher, crystal grains of the steel sheet were coarsened, but the coarsening degree thereof was small.

On the other hand, when the values of "$8\times C\ (\%)+1.3\times Mn\ (\%)+18\times P\ (\%)+5.1\times(Nb\ (\%))^{0.5}$" of the expressions (1) and (2) were higher than 4.00, adhesion between the steel sheet and glass during vitreous enameling deteriorated. Therefore, the upper limit of "$8\times C\ (\%)+1.3\times Mn\ (\%)+18\times P\ (\%)+5.1\times(Nb\ (\%))^{0.5}$" was set as 4.00.

Figure 3:
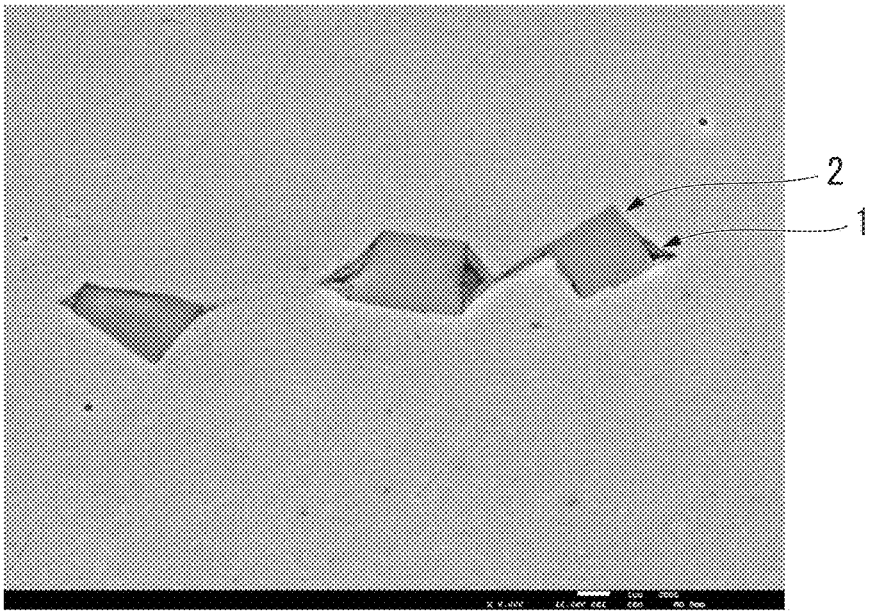
FIG. 3 is a diagram showing an example in which voids are present in a steel sheet for vitreous enameling according to an embodiment of the present invention.

Next, the voids present in the steel sheet for vitreous enameling according to the embodiment will be described. The voids are formed in the boundaries between the steel sheet and the composite oxides during processing because there is a difference in deformation resistance between the steel sheet and the composite oxides and it is more difficult to deform the composite oxides than the steel sheet. The voids are formed during hot rolling or cold rolling. Therefore, each of the voids exhibits a pseudo-triangular shape (substantially triangular shape) in a direction in which the steel sheet extends by rolling (in a cross-section in a rolling direction). FIG. 3 shows an example of the voids. Such voids function as trap sites for hydrogen in steel, and it is preferable that the voids are present in order to suppress fishscale defects. However, when the size of the voids increases, during processing such as press forming for obtaining a product, the voids may become starting point of cracking due to strains concentrated thereon. In addition, when vitreous enameling is performed after processing, grain growth is likely to occur in the strain-concentrated portions. Therefore, when a large void is present, crystal grains are coarsened after vitreous enameling, and fatigue properties decrease. Further, when the steel sheet is used as an enameled product, the concentration of strains on the voids causes a decrease in fatigue properties.

In order to suppress a decrease in fatigue properties caused by the voids, it is important to relax the strain concentration on the voids. The present inventors found the following results. In the steel sheet for vitreous enameling according to the embodiment, by setting the equivalent circle diameter of the voids to be 0.6 μm or less, the stress concentration on the voids becomes relaxed and a decrease in fatigue properties is suppressed even after processing and vitreous enameling. However, when the size of the voids is excessively small, the voids cannot function as the trap sites for hydrogen in steel. Therefore, the lower limit of the equivalent circle diameter of the voids is set as 0.1 μm.

Further, the present inventors found that, even when the equivalent circle diameter of the voids is 0.6 μm or less, fatigue properties may decrease. That is, the present inventors found that, fatigue properties are affected not only by the size of the voids but also by the shape thereof. As described above, each of the voids formed in the boundaries between the steel sheet and the composite oxides during hot rolling or cold rolling exhibits a pseudo-triangular shape. The shape of the voids is changed by conditions of hot rolling or cold rolling. When the angle of a tip end of the triangle becomes more acute, strains are likely to be concentrated during the application of stress, which may cause the coarsening of crystal grains after vitreous enameling. In addition, when the steel sheet is used as a product, fatigue properties decrease due to strain concentration.

As the tip angle of the triangle of the void becomes more acute, a decrease in fatigue properties becomes more severe. However, in a case where a long side of the triangle is set as a base, when a value obtained by dividing the length of the base by the height of the triangle is higher than 15, a decrease in fatigue properties is remarkable. Therefore, in the steel sheet for vitreous enameling according to the embodiment, when each of the voids is approximated as a triangle and a long side of the triangle is set as a base, a value obtained by dividing the length of the base by the height of the triangle is 15 or less. In addition, in a case where each of the voids is approximated as a triangle and a long side of the triangle is set as a base, when a value obtained by dividing the length of the base by the height of the triangle is less than 1.0, the vertical angle of the triangle of the void is reduced, and strains are concentrated. Therefore, the lower limit of the value obtained by dividing the length of the base by the height of the triangle is set as 1.0.

The equivalent circle diameter and the triangular shape of the voids were defined using the following method. That is, using a SEM, the long side and height of the triangle of each of the voids were measured in 10 or more view fields at a magnification of 5000-fold. In addition, the equivalent circle diameter was converted from the area of the triangle.

The method of producing the steel sheet for vitreous enameling according to the embodiment and the method of producing the enameled product according to the embodiment will be described.

The steel sheet for vitreous enameling according to the embodiment can be produced from molten steel having the above-described chemical composition through refining, casting, hot rolling, pickling, cold rolling, continuous annealing, and temper rolling and the like based on a typical method.

During hot rolling, the heating temperature of a steel piece is preferably 1150° C. to 1250° C., the rolling reduction (cumulative rolling reduction) is preferably 30% to 90%, and the finishing temperature is preferably 900° C. or higher.

The composite oxides containing Fe, Mn, and Nb or the composite oxides containing Fe, Mn, Nb, and B produced in the refining and casting processes are stretched by hot rolling. During this hot rolling, the composite oxides are stretched and crushed by rolling, and are changed into more preferable forms for securing the desired properties. In order to uniformly disperse the composite oxides in the steel sheet, it is effective to perform rolling at a given rolling reduction. That is, by setting the hot-rolling reduction to be 30% or higher, the composite oxides in steel can be sufficiently stretched, and the size and number density of the composite oxides obtained after cold rolling and continuous annealing can be easily controlled to be within a desired range. However, when the hot-rolling reduction is higher than 90%, the size of the composite oxides in steel is extremely small, and excellent fishscale resistance may not be obtained.

In addition, in the pickling process after hot rolling, scales generated on the surface are removed. In the pickling process, it is important to perform pickling under conditions where the production in the cold rolling process, which is the next process, is not inhibited by remaining scales and the like. For example, in the pickling process using hydrochloric acid, basically, pickling may be performed at a concentration of about 8% and a liquid temperature of about 90° C. for a dipping time of about 60 seconds. Pickling using sulfuric acid is not preferable. This is because, in pickling using sulfuric acid, the surface having high concentrations of elements is removed more than necessary by excessive pickling.

After pickling, in the cold rolling process, the steel sheet is further stretched at a maximum temperature of about 150° C. Therefore, in the cold rolling, it is difficult to stretch the hard composite oxides.

In the cold rolling, the cold-rolling reduction (cumulative rolling reduction) is important to determine properties of a product and is preferably 65% to 85%. The hard composite oxides which function as hydrogen trap sites are crushed in the cold rolling step. Therefore, the size and number density of the composite oxides present in a final product change depending on the cold-rolling reduction. Likewise, the voids which function as hydrogen trap sites are formed by crushing the hard composite oxides in the cold rolling step. By crushing the hard composite oxides, the size and number density of the composite oxides are optimized. Therefore, in order to form the voids and to secure excellent formability after annealing, it is preferable that the cold-rolling reduction is set to be 65% or higher. The voids act effectively on fishscale resistance but act disadvantageously on workability. Accordingly, the presence of an unnecessary amount of voids causes a decrease in workability and deterioration in the fatigue properties of a product after processing and vitreous enameling. Therefore, it is preferable that the upper limit of the cold-rolling reduction is set as 85%. When the cold-rolling reduction exceeds 85%, the composite oxides are crushed more than necessary, and the size thereof is extremely small. Therefore, the number density of the composite oxides which are effective for fishscale resistance is reduced. In addition, the metallographic structure is observed in which the formed voids collapse and are eliminated. When the shape of the voids formed by cold rolling, that is, each of the voids is approximated as a triangle and a long side of the triangle is set as a base, a value obtained by dividing the length of the base by the height of the triangle increases. Therefore, the effect of improving fishscale resistance is reduced. Further, when the voids are not eliminated by structural bonding, the voids cause cracking due to strains introduced by the processing, and thus workability deteriorates.

In general, in the cold rolling, a larger amount of strains are introduced into the surface part of the steel sheet than the inside of the steel sheet. However, a friction coefficient between a roll and the steel sheet can be reduced through selection of cold rolling oil or the like. Accordingly, a difference in the introduced strains between the surface part and the inside of the steel sheet can be reduced, and the introduction of an excess amount of strains into the surface part can be suppressed. As a result, the void shape can be preferably controlled.

In order to obtain a preferable void shape in the steel sheet for vitreous enameling according to the embodiment, the friction coefficient between the rolling mill roll and the steel sheet is preferably 0.015 to 0.060 and more preferably 0.015 to 0.040. However, a relationship between the friction coefficient and the void shape varies depending on the settings of a rolling mill. The friction coefficient can be calculated by repeatedly performing calculation according to a general rolling method, that is, according to a rolling theory using a two-dimensional slab method such that calculated values of a forward slip and a rolling force match measured values thereof.

In the related art, rolling in which the friction coefficient between a rolling mill roll and a steel sheet is controlled was not performed.

After cold rolling, the cold-rolled steel sheet is annealed. From the viewpoint of productivity, it is preferable that the annealing is continuous annealing using a continuous annealing line. The annealing temperature is preferably 700° C. to 850° C. However, from the viewpoint of imparting distinctive mechanical properties, the annealing temperature may be lower than 700° C. or may be higher than 850° C.

After continuous annealing, temper rolling may be performed to mainly control the shape. In this temper rolling, a steel sheet for vitreous enameling having desired characteristics can be obtained.

The enameled product according to the embodiment can be obtained from the steel sheet for vitreous enameling according to the embodiment through processing for obtaining a desired shape, such as pressing or roll forming, and vitreous enameling. The processing such as pressing or roll forming and vitreous enameling may be performed according to a typical method. For example, in the vitreous enameling, the steel sheet coated with an enamel is heated to, for example, 800° C. to 850° C. and is left to stand for 1 minute to 10 minutes such that glass of the enamel and the steel sheet adhere to each other.

EXAMPLES

Next, examples of the present invention will be described. However, conditions of the examples are merely exemplary to confirm the operability and the effects of the present invention, and the present invention is not limited to these condition examples. The present invention can adopt various conditions within a range not departing from the scope of the present invention as long as the object of the present invention can be achieved under the conditions.

Steel having the component compositions shown in Table 1 was melted in a converter, and slabs (steel pieces) were prepared through continuous casting based on a typical method. These slabs were heated to 1150° C. to 1250° C. in a heating furnace for hot rolling. Hot rolling was finished at a finishing temperature of 900° C. or higher. After hot rolling, the hot-rolled steel sheets were coiled at 700° C. to 750° C.

The hot-rolled steel sheets were pickled and cold-rolled at cold-rolling reductions shown in Table 2 to obtain cold-rolled steel sheets. Next, the cold-rolled steel sheets were continuously annealed at 780° C. Next, through 1.2% of temper rolling, steel sheets for vitreous enameling having a thickness of 0.8 mm were prepared. In order to make the thicknesses after temper rolling to be uniform, the thicknesses of the hot-rolled steel sheets were changed relative to the rolling reductions of cold rolling.

The friction coefficient between the rolling mill roll and the steel sheets was 0.025.

The steel sheets for vitreous enameling were evaluated in various ways. Regarding the mechanical properties, a tension test was performed according to JIS Z 2241 using JIS No. 5 specimen to measure the tensile strength (TS) and breaking elongation. The average grain size of the steel sheets was measured near a ¼ thickness position according to JIS G 0552.

The diameter and number densities of the oxides in each of the steel sheets were measured using the above-described method by observing a cross-section of the steel sheet parallel to a cold rolling direction with a SEM.

Workability was evaluated in a 90° bending test using a V block method according to JIS Z 2248. While changing the inner bending radius, each of the steel sheets was bent by 90°. The outer surface of the bent portion was observed by visual inspection to evaluate whether or not cracking occurred. The occurrence of cracking was determined based on three stages: A: when the inner radius was 0.5 mm or less, no cracking occurred; B: when the inner radius was more than 0.5 mm and 2.5 mm or less, no cracking occurred; and C: when the inner radius was more than 2.5 mm, cracking occurred. In this case, A and B were considered as "Pass".

In the evaluation of fatigue properties, an alternating stress fatigue test was performed on the steel sheets after performing a heat treatment with an applied tensile strain of 10% at a heating temperature of 830° C. corresponding to vitreous enameling for a holding time of 5 minutes. In the evaluation of fatigue properties, a stress at $10^7$ cycles was obtained as a fatigue strength (σw), and this fatigue strength was divided by a tensile strength (TS) obtained in the tension test which was performed on the steel sheets after the heat treatment. The obtained value (σw/TS) was set as a fatigue limit ratio. When the value of the fatigue limit ratio exceeded 0.42, fatigue properties were considered as "Pass".

In the evaluation of enameling characteristics, each of the steel sheets was coated with an enamel at a thickness of 100 μm using a dry electrostatic powder coating method and was fired in air at 830° C. for 5 minutes. Using these steel sheets, fishscale resistance and adhesion were evaluated. In the evaluation of fishscale resistance, the steel sheets after vitreous enameling underwent a fishscale promoting test of being put into a thermostatic chamber at 160° C. for 10 hours. Next, using these steel sheets, the occurrence of fishscale was determined by visual inspection based on four steps: A: high; B: slightly high; C: normal; and D: problematic. In this case, A to C were considered as "Pass".

In addition, in the evaluation of enamel adhesion, a 2 kg ball head weight is caused to fall from a height of 1 m. Next, the enamel peeling state of a deformed part was measured using 169 palpation needles, and the area ratio of non-peeled portions was obtained. The area ratio of non-peeled portions was evaluated based on four stages: A: 95% or higher; B: higher than 85% and lower than 95%; C: higher than 70% and lower than 85%; and D: 70% or lower. In this case, A to C were considered as "Pass".

The evaluation results are shown in Table 2.

In Production Nos. 1 to 33 which are examples according to the present invention, the Fe—Mn—Nb-based composite oxides or the Fe—Mn—Nb—B-based composite oxides having a diameter of more than 10 μm were not observed in the steel.

In addition, it was found that, in the steel sheets in which the number of the Fe—Mn—Nb-based composite oxides or the Fe—Mn—Nb—B-based composite oxides having a diameter of 0.2 μm to 10 μm per unit area was within the range of the present invention ($2\times10^2$ particle/mm$^2$ to $1\times10^4$ particle/mm$^2$), workability was satisfactory while maintaining fishscale resistance.

Further, it was found that, in the steel sheets in which the value of "$8\times C\ (\%)+1.3\times Mn\ (\%)+18\times P\ (\%)+5.1\times(Nb\ (\%))^{0.5}$" (expression (1x)) of the expression (1) was within the range of the present invention, fatigue properties and adhesion were excellent. When the amount of the components and the value of the expression (1x) did not satisfy the range of the present invention, workability, enameling characteristics, and fatigue properties were not able to be simultaneously satisfied.

It can be seen from the results of Tables 1 and 2 that, in the high-strength steel sheets for vitreous enameling of Production Nos. 1 to 33 which are examples according to the present invention, fatigue properties were higher while maintaining workability and fishscale resistance, as compared to a steel sheet for vitreous enameling of the related art. On the other hand, in Production Nos. 34 to 48 which are comparative examples, workability, fatigue properties, fishscale resistance, and adhesion were not sufficient.

TABLE 1

| | Component (mass %) | | | | | | | | | | | | Expression |
|---|---|---|---|---|---|---|---|---|---|---|---|---|---|
| Steel No. | C | Mn | Si | Al | N | O | P | S | Nb | Cu | B | Other Components | (1x) or (2x) |
| A1 | 0.0012 | 0.35 | 0.005 | 0.002 | 0.0025 | 0.0253 | 0.053 | 0.0235 | 0.043 | 0.027 | — | — | 2.48 |
| A2 | 0.0015 | 1.38 | 0.008 | 0.003 | 0.0028 | 0.0283 | 0.046 | 0.0243 | 0.065 | 0.029 | — | — | 3.93 |
| A3 | 0.0012 | 0.26 | 0.005 | 0.003 | 0.0032 | 0.0263 | 0.075 | 0.0350 | 0.048 | 0.025 | — | — | 2.81 |
| A4 | 0.0014 | 1.32 | 0.006 | 0.002 | 0.0028 | 0.0254 | 0.068 | 0.0273 | 0.032 | 0.026 | — | — | 3.86 |
| A5 | 0.0012 | 0.80 | 0.004 | 0.004 | 0.0027 | 0.0215 | 0.095 | 0.0432 | 0.043 | 0.030 | — | — | 3.82 |
| A6 | 0.0015 | 0.63 | 0.012 | 0.003 | 0.0032 | 0.0285 | 0.065 | 0.0325 | 0.062 | 0.040 | — | — | 3.27 |
| A7 | 0.0038 | 0.35 | 0.006 | 0.005 | 0.0024 | 0.0198 | 0.053 | 0.0125 | 0.032 | 0.031 | — | — | 2.35 |
| A8 | 0.0015 | 0.42 | 0.003 | 0.003 | 0.0025 | 0.0233 | 0.052 | 0.0283 | 0.072 | 0.025 | — | — | 2.86 |
| A9 | 0.0022 | 0.07 | 0.006 | 0.003 | 0.0033 | 0.0323 | 0.068 | 0.0267 | 0.046 | 0.032 | — | — | 2.43 |
| A10 | 0.0045 | 0.32 | 0.004 | 0.002 | 0.0021 | 0.0430 | 0.048 | 0.0243 | 0.035 | 0.028 | — | — | 2.27 |
| A11 | 0.0014 | 0.85 | 0.007 | 0.003 | 0.0019 | 0.0264 | 0.068 | 0.0256 | 0.030 | 0.038 | — | — | 3.22 |
| A12 | 0.0013 | 1.35 | 0.004 | 0.004 | 0.0028 | 0.0356 | 0.053 | 0.0276 | 0.045 | 0.028 | — | — | 3.80 |
| A13 | 0.0012 | 0.34 | 0.008 | 0.005 | 0.0024 | 0.0265 | 0.057 | 0.0432 | 0.048 | 0.042 | 0.0015 | — | 2.59 |
| A14 | 0.0015 | 1.42 | 0.004 | 0.008 | 0.0026 | 0.0247 | 0.048 | 0.0312 | 0.045 | 0.036 | 0.0018 | — | 3.80 |
| A15 | 0.0014 | 0.33 | 0.005 | 0.004 | 0.0034 | 0.0483 | 0.063 | 0.0296 | 0.043 | 0.029 | 0.0006 | — | 2.63 |
| A16 | 0.0013 | 1.43 | 0.006 | 0.003 | 0.0037 | 0.0256 | 0.062 | 0.0245 | 0.032 | 0.026 | 0.0025 | — | 3.90 |
| A17 | 0.0016 | 0.65 | 0.003 | 0.004 | 0.0033 | 0.0249 | 0.091 | 0.0286 | 0.041 | 0.027 | 0.0035 | — | 3.53 |
| A18 | 0.0013 | 0.46 | 0.006 | 0.008 | 0.0033 | 0.0195 | 0.065 | 0.0322 | 0.042 | 0.032 | 0.0012 | | 2.82 |
| A19 | 0.0014 | 0.78 | 0.004 | 0.003 | 0.0025 | 0.0289 | 0.062 | 0.0275 | 0.046 | 0.036 | 0.0045 | — | 3.24 |
| A20 | 0.0042 | 0.45 | 0.005 | 0.002 | 0.0024 | 0.0432 | 0.052 | 0.0245 | 0.035 | 0.031 | 0.0021 | — | 2.51 |
| A21 | 0.0013 | 0.32 | 0.003 | 0.002 | 0.0021 | 0.0275 | 0.083 | 0.0263 | 0.043 | 0.027 | 0.0015 | — | 2.98 |
| A22 | 0.0015 | 0.48 | 0.005 | 0.004 | 0.0024 | 0.2264 | 0.057 | 0.0316 | 0.076 | 0.029 | 0.0026 | — | 3.07 |
| A23 | 0.0035 | 0.42 | 0.006 | 0.005 | 0.0024 | 0.0245 | 0.052 | 0.0135 | 0.041 | 0.022 | 0.0023 | — | 2.54 |
| A24 | 0.0013 | 0.44 | 0.004 | 0.003 | 0.0022 | 0.0278 | 0.056 | 0.0245 | 0.048 | 0.032 | — | Cr: 0.012<br>Ni: 0.023 | 2.71 |
| A25 | 0.0013 | 1.21 | 0.005 | 0.004 | 0.0026 | 0.0325 | 0.072 | 0.0237 | 0.038 | 0.036 | — | Sr: 0.007<br>Ca: 0.005<br>Sb: 0.003 | 3.87 |
| A26 | 0.0040 | 0.42 | 0.006 | 0.003 | 0.0034 | 0.0245 | 0.053 | 0.0239 | 0.041 | 0.021 | — | La: 0.052<br>Ca: 0.019 | 2.56 |
| A27 | 0.0013 | 0.53 | 0.007 | 0.003 | 0.0024 | 0.0422 | 0.068 | 0.0245 | 0.045 | 0.024 | — | Mo: 0.025<br>W: 0.007<br>Ta: 0.005 | 3.01 |
| A28 | 0.0013 | 0.53 | 0.005 | 0.003 | 0.0033 | 0.0503 | 0.052 | 0.0269 | 0.071 | 0.029 | — | Ti: 0.011 | 2.99 |
| A29 | 0.0012 | 0.43 | 0.005 | 0.003 | 0.0019 | 0.0432 | 0.052 | 0.0241 | 0.043 | 0.024 | 0.0026 | Ni: 0.035<br>Mg: 0.007 | 2.56 |
| A30 | 0.0014 | 1.23 | 0.005 | 0.004 | 0.0020 | 0.0326 | 0.065 | 0.0263 | 0.049 | 0.028 | 0.0021 | As: 0.001<br>Se: 0.002 | 3.91 |
| A31 | 0.0013 | 0.45 | 0.004 | 0.004 | 0.0021 | 0.0275 | 0.057 | 0.0243 | 0.052 | 0.027 | 0.0018 | Ni: 0.042 | 2.78 |
| A32 | 0.0043 | 0.42 | 0.003 | 0.004 | 00026 | 0.0283 | 0.062 | 0.0235 | 0.045 | 0.024 | 0.0019 | La: 0.043<br>Ca: 0.012 | 2.78 |
| A33 | 0.0013 | 0.32 | 0.004 | 0.004 | 0.0021 | 0.0246 | 0.058 | 0.0245 | 0.073 | 0.027 | 0.0008 | Ti: 0.013 | 2.85 |
| AB1 | 0.0015 | 0.35 | 0.003 | 0.003 | 0.0026 | 0.0283 | 0.068 | 0.0273 | 0.046 | 0.026 | 0.0026 | — | 2.78 |
| AB2 | 0.0012 | 0.33 | 0.005 | 0.002 | 0.0026 | 0.0295 | 0.050 | 0.0253 | 0.045 | 0.026 | — | — | 2.42 |
| B1 | 0.0010 | 0.32 | 0.005 | 0.003 | 0.0021 | 0.0241 | 0.014 | 0.0263 | 0.046 | 0.029 | 0.0016 | — | 1.77 |
| B2 | 0.0015 | 1.45 | 0.006 | 0.004 | 0.0025 | 0.0352 | 0.058 | 0.0362 | 0.063 | 0.038 | — | — | 4.22 |
| B3 | 0.0014 | 0.33 | 0.003 | 0.003 | 0.0023 | 0.0050 | 0.063 | 0.0323 | 0.050 | 0.039 | 0.0018 | — | 2.71 |
| B4 | 0.0016 | 0.35 | 0.007 | 0.002 | 0.0041 | 0.0285 | 0.045 | 0.0264 | 0.005 | 0.028 | — | — | 1.64 |
| B5 | 0.0013 | 0.82 | 0.004 | 0.004 | 0.0032 | 0.0252 | 0.062 | 0.0255 | 0.043 | 0.023 | 0.0730 | — | 3.25 |
| B6 | 0.0430 | 0.42 | 0.004 | 0.003 | 0.0028 | 0.0350 | 0.063 | 0.0286 | 0.048 | 0.021 | — | — | 3.14 |
| B7 | 0.0013 | 0.43 | 0.043 | 0.002 | 0.0025 | 0.0180 | 0.045 | 0.0269 | 0.049 | 0.027 | — | — | 2.51 |
| B8 | 0.0016 | 0.48 | 0.003 | 0.035 | 0.0033 | 0.0163 | 0.058 | 0.0316 | 0.056 | 0.034 | 0.0015 | — | 2.85 |
| B9 | 0.0018 | 0.86 | 0.002 | 0.003 | 0.0026 | 0.0650 | 0.062 | 0.0236 | 0.062 | 0.033 | — | — | 3.52 |
| B10 | 0.0013 | 0.31 | 0.005 | 0.002 | 0.0021 | 0.0283 | 0.040 | 0.0253 | 0.042 | 0.028 | — | — | 2.18 |
| B11 | 0.0015 | 0.33 | 0.003 | 0.003 | 0.0024 | 0.0433 | 0.052 | 0.0263 | 0.043 | 0.024 | 00018 | La: 0.068<br>Ca: 0.058 | 2.43 |
| B12 | 0.0013 | 0.06 | 0.004 | 0.003 | 0.0022 | 0.0253 | 0.041 | 0.0256 | 0.030 | 0.026 | 0.0016 | — | 1.71 |
| B13 | 0.0014 | 1.23 | 0.004 | 0.003 | 0.0023 | 0.0262 | 0.083 | 0.0243 | 0.070 | 0.025 | 0.0018 | — | 4.45 |

TABLE 2

| | Production No. | Steel No. | Cold-Rolling Reduction (%) | Average Grain Size (μm) | Density of Oxides of 0.2 μm to 10 μm (particle/mm$^2$) | Base/Height Ratio of Void | Equivalent Circle Diameter of Voids (μm) | Mechanical Characteristics TS (MPa) | Mechanical Characteristics EL (%) | Workability Limit Bendability | Fatigue Properties (after Heat Treatment) Fatigue Limit Ratio (σw/TS) | Enameling Characteristics Fishscale Resistance | Enameling Characteristics Adhesion |
|---|---|---|---|---|---|---|---|---|---|---|---|---|---|
| Examples according Present Invention | 1 | A1 | 78 | 10.4 | $3.0 \times 10^3$ | 10.3 | 0.41 | 353 | 40 | A | 0.44 | B | A |
| | 2 | A2 | 78 | 9.8 | $4.5 \times 10^3$ | 10.4 | 0.43 | 427 | 32 | B | 0.52 | A | B |
| | 3 | A3 | 81 | 9.6 | $2.1 \times 10^3$ | 11.8 | 0.36 | 369 | 38 | A | 0.46 | C | B |
| | 4 | A4 | 81 | 10.1 | $3.1 \times 10^3$ | 13.2 | 0.41 | 423 | 32 | B | 0.51 | B | B |
| | 5 | A5 | 78 | 9.1 | $2.8 \times 10^3$ | 11.2 | 0.38 | 419 | 32 | B | 0.51 | C | B |
| | 6 | A6 | 77 | 9.4 | $1.2 \times 10^3$ | 11.3 | 0.34 | 393 | 35 | B | 0.48 | C | C |
| | 7 | A7 | 78 | 10.1 | $8.0 \times 10^2$ | 10.8 | 0.33 | 347 | 41 | A | 0.44 | C | A |
| | 8 | A8 | 78 | 9.4 | $1.8 \times 10^3$ | 10.6 | 0.32 | 372 | 38 | A | 0.46 | B | B |
| | 9 | A9 | 78 | 9.8 | $5.2 \times 10^2$ | 10.8 | 0.31 | 350 | 41 | A | 0.44 | C | A |
| | 10 | A10 | 78 | 10.8 | $7.0 \times 10^3$ | 10.4 | 0.48 | 339 | 42 | A | 0.43 | A | A |
| | 11 | A11 | 88 | 10.3 | $3.4 \times 10^3$ | 7.3 | 0.48 | 391 | 36 | B | 0.48 | B | B |
| | 12 | A12 | 83 | 10.1 | $6.2 \times 10^3$ | 13.5 | 0.41 | 420 | 32 | B | 0.51 | A | C |
| | 13 | A13 | 78 | 9.9 | $3.2 \times 10^3$ | 9.8 | 0.43 | 364 | 39 | A | 0.47 | A | A |
| | 14 | A14 | 78 | 9.6 | $2.9 \times 10^3$ | 9.6 | 0.41 | 425 | 32 | B | 0.53 | B | C |
| | 15 | A15 | 84 | 10.2 | $7.3 \times 10^3$ | 13.8 | 0.42 | 357 | 40 | A | 0.47 | A | A |
| | 16 | A16 | 78 | 9.7 | $2.8 \times 10^3$ | 9.8 | 0.42 | 430 | 31 | B | 0.55 | B | C |
| | 17 | A17 | 78 | 9.1 | $2.9 \times 10^3$ | 11.2 | 0.43 | 410 | 33 | B | 0.55 | B | C |
| | 18 | A18 | 78 | 9.6 | $8.0 \times 10^3$ | 10.8 | 0.36 | 375 | 37 | B | 0.48 | C | B |
| | 19 | A19 | 66 | 10.2 | $3.1 \times 10^3$ | 4.3 | 0.46 | 396 | 35 | B | 0.51 | B | B |
| | 20 | A20 | 81 | 9.8 | $6.7 \times 10^3$ | 12.8 | 0.44 | 360 | 39 | A | 0.45 | A | A |
| | 21 | A21 | 77 | 9.7 | $3.8 \times 10^3$ | 9.8 | 0.43 | 382 | 37 | B | 0.49 | A | B |
| | 22 | A22 | 78 | 9.5 | $3.4 \times 10^3$ | 10.6 | 0.42 | 387 | 36 | B | 0.49 | A | B |
| | 23 | A23 | 78 | 10.1 | $2.9 \times 10^3$ | 11.2 | 0.38 | 361 | 39 | A | 0.46 | B | A |
| | 24 | A24 | 78 | 10.1 | $3.8 \times 10^3$ | 10.2 | 0.42 | 367 | 38 | A | 0.46 | B | B |
| | 25 | A25 | 81 | 9.4 | $4.8 \times 10^3$ | 13.2 | 0.43 | 426 | 32 | B | 0.51 | A | C |
| | 26 | A26 | 78 | 10.2 | $3.1 \times 10^3$ | 10.2 | 0.41 | 361 | 39 | A | 0.45 | B | B |
| | 27 | A27 | 86 | 9.8 | $6.8 \times 10^3$ | 3.4 | 0.56 | 382 | 37 | B | 0.47 | A | B |
| | 28 | A28 | 82 | 9.8 | $8.9 \times 10^3$ | 13.3 | 0.44 | 382 | 37 | B | 0.47 | A | B |
| | 29 | A29 | 67 | 10.1 | $6.7 \times 10^3$ | 4.2 | 0.53 | 362 | 39 | A | 0.45 | A | B |
| | 30 | A30 | 78 | 9.7 | $5.2 \times 10^3$ | 11.4 | 0.44 | 430 | 31 | B | 0.54 | A | C |
| | 31 | A31 | 78 | 10.3 | $4.2 \times 10^3$ | 10.3 | 0.42 | 373 | 38 | A | 0.47 | A | B |
| | 32 | A32 | 81 | 9.4 | $3.4 \times 10^3$ | 12.8 | 0.43 | 373 | 38 | A | 0.47 | B | B |
| | 33 | A33 | 84 | 9.4 | $3.1 \times 10^3$ | 14.2 | 0.42 | 376 | 37 | A | 0.47 | B | B |
| Comparative Example | 34 | AB1 | 60 | 10.8 | $1.6 \times 10^2$ | 0.9 | 0.64 | 373 | 38 | C | 0.46 | D | B |
| | 35 | B1 | 78 | 14.3 | $2.8 \times 10^3$ | 11.0 | 0.38 | 323 | 44 | A | 0.38 | B | A |
| | 36 | B2 | 78 | 10.1 | $4.7 \times 10^3$ | 10.8 | 0.42 | 461 | 29 | B | 0.55 | A | D |
| | 37 | B3 | 78 | 9.8 | $0.5 \times 10^2$ | 11.1 | 0.04 | 393 | 35 | B | 0.43 | D | B |
| | 38 | B4 | 81 | 11.3 | $1.2 \times 10^2$ | 12.4 | 0.41 | 317 | 45 | A | 0.37 | D | A |
| | 39 | B5 | 78 | 10.4 | $3.1 \times 10^3$ | 10.3 | 0.42 | 397 | 35 | C | 0.48 | B | C |
| | 40 | B6 | 78 | 9.3 | $4.3 \times 10^3$ | 10.5 | 0.44 | 391 | 36 | C | 0.48 | B | C |
| | 41 | B7 | 78 | 10.2 | $0.8 \times 10^2$ | 11.4 | 0.06 | 363 | 39 | B | 0.45 | D | C |
| | 42 | B8 | 78 | 9.8 | $0.6 \times 10^2$ | 11.3 | 0.05 | 376 | 37 | B | 0.46 | D | C |
| | 43 | B9 | 79 | 9.7 | $2.0 \times 10^4$ | 13.2 | 0.73 | 410 | 33 | C | 0.40 | B | C |
| | 44 | B10 | 83 | 10.2 | $3.3 \times 10^3$ | 13.9 | 0.42 | 343 | 41 | B | 0.41 | B | B |
| | 45 | B11 | 78 | 9.8 | $1.2 \times 10^2$ | 10.8 | 0.33 | 356 | 40 | C | 0.40 | D | C |
| | 46 | B12 | 78 | 10.8 | $3.2 \times 10^3$ | 10.9 | 0.46 | 320 | 45 | A | 0.37 | B | A |
| | 47 | B13 | 78 | 10.1 | $3.3 \times 10^3$ | 11.1 | 0.47 | 457 | 29 | B | 0.54 | B | D |
| | 48 | AB2 | 88 | 9.8 | $2.8 \times 10^3$ | 16.2 | 0.08 | 355 | 10 | C | 0.41 | C | A |

INDUSTRIAL APPLICABILITY

According to the present invention, it is possible to provide: a high-strength steel sheet for vitreous enameling having excellent workability and fishscale resistance; and an enameled product which is produced using the steel sheet for vitreous enameling. When the high-strength steel sheet for vitreous enameling according to the present invention is applied to the energy fields in addition to kitchenware and building materials, the reliability against fatigue and the like caused by a long period of use can be improved, and the weight of a product can be reduced. Accordingly, the present invention is highly applicable to the industries in which the steel sheet for vitreous enameling is produced and used.

BRIEF DESCRIPTION OF THE REFERENCE SYMBOLS

1: VOID

2: Fe—Mn—Nb-BASED COMPOSITE OXIDE

The invention claimed is:

1. A cold-rolled steel sheet for vitreous enameling, the steel sheet comprising, by mass %, C: 0.0005% to 0.0050%, Mn: 0.05% to 1.50%, Si: 0.001% to 0.015%, Al: 0.001% to 0.01%, N: 0.0010% to 0.0045%, O: 0.0150% to 0.0550%, P: 0.04% to 0.10%, S: 0.0050% to 0.050%,
Nb: 0.020% to 0.080%,
Cu: 0.015% to 0.045%, and
a remainder including Fe and impurities,
wherein when a C content is represented by C (%), a Mn content is represented by Mn (%), a P content is represented by P (%), and a Nb content is represented by Nb (%), the following expression (1) is satisfied;
a metallographic structure contains ferrite, and an average grain size of the ferrite at a ¼ thickness position from a surface in a thickness direction is 12.0 μm or less;
a number density of Fe—Mn—Nb-based composite oxides containing Fe, Mn, and Nb and having a diameter of 0.2 μm to 10 μm is $2\times10^2$ particle/mm$^2$ to $1\times10^4$ particle/mm$^2$;
a fatigue limit ratio, which is a value obtained by dividing a fatigue strength by a tensile strength, is higher than 0.42, the fatigue strength being a stress at $10^7$ cycles after performing a heat treatment with an applied tensile strain of 10% at a heating temperature of 830° C. for a holding time of 5 minutes;
voids are formed between the metallographic structure and the Fe—Mn—Nb-based composite oxides, and an equivalent circle diameter of the voids is 0.1 μm to 0.6 μm; and
when each of the voids is approximated as a triangle and a long side of the triangle is set as a base, a value obtained by dividing a length of the base by a height of the triangle is 1.0 to 15;

$$2.20\leq 8\times C\ (\%)+1.3\times Mn\ (\%)+18\times P\ (\%)+5.1\times(Nb\ (\%))^{0.5}\leq 4.00 \quad (1).$$

2. A cold-rolled steel sheet for vitreous enameling, the steel sheet comprising, by mass %,
C: 0.0005% to 0.0050%,
Mn: 0.05% to 1.50%,
Si: 0.001% to 0.015%,
Al: 0.001% to 0.01%,
N: 0.0010% to 0.0045%,
O: 0.0150% to 0.0550%,
P: 0.04% to 0.10%,
S: 0.0050% to 0.050%,
Nb: 0.020% to 0.080%,
Cu: 0.015% to 0.045%,
B: 0.0005% to 0.0050%, and
a remainder including Fe and impurities,
wherein when a C content is represented by C (%), a Mn content is represented by Mn (%), a P content is represented by P (%), and a Nb content is represented by Nb (%), the following expression (2) is satisfied;
a metallographic structure contains ferrite, and an average grain size of the ferrite at a ¼ thickness position from a surface in a thickness direction is 12.0 μm or less;
a number density of Fe—Mn—Nb—B-based composite oxides containing Fe, Mn, Nb, and B and having a diameter of 0.2 μm to 10 μm is $2\times10^2$ particle/mm$^2$ to $1\times10^4$ particle/mm$^2$;
a fatigue limit ratio, which is a value obtained by dividing a fatigue strength by a tensile strength, is higher than 0.42, the fatigue strength being a stress at $10^7$ cycles after performing a heat treatment with an applied tensile strain of 10% at a heating temperature of 830° C. for a holding time of 5 minutes;
voids are formed between the metallographic structure and the Fe—Mn—Nb—B-based composite oxides, and an equivalent circle diameter of the voids is 0.1 μm to 0.6 μm; and
when each of the voids is approximated as a triangle and a long side of the triangle is set as a base, a value obtained by dividing a length of the base by a height of the triangle is 1.0 to 15;

$$2.50\leq 8\times C\ (\%)+1.3\times Mn\ (\%)+18\times P\ (\%)+5.1\times(Nb\ (\%))^{0.5}\leq 4.00 \quad (2).$$

3. The cold-rolled steel sheet for vitreous enameling according to claim 1, further comprising, by mass %,
one or more elements selected from the group consisting of Cr, V, Zr, Ni, As, Ti, Se, Ta, W, Mo, Sn, Sb, La, Ce, Ca, and Mg,
wherein a total amount of the elements is 0.1% or lower.

4. An enameled product which is produced using the cold-rolled steel sheet for vitreous enameling according to claim 1.

5. An enameled product which is produced using the cold-rolled steel sheet for vitreous enameling according to claim 3.

6. The cold-rolled steel sheet for vitreous enameling according to claim 2, further comprising, by mass %,
one or more elements selected from the group consisting of Cr, V, Zr, Ni, As, Ti, Se, Ta, W, Mo, Sn, Sb, La, Ce, Ca, and Mg,
wherein a total amount of the elements is 0.1% or lower.

7. An enameled product which is produced using the cold-rolled steel sheet for vitreous enameling according to claim 2.

* * * * *